US006557311B1

(12) United States Patent
Mongelli

(10) Patent No.: US 6,557,311 B1
(45) Date of Patent: May 6, 2003

(54) RETROMOLDING EXTENDER

(76) Inventor: Richard Anthony Mongelli, 130 N. Hewlett Ave., Merrick, NY (US) 11566

( * ) Notice: Subject to any disclaimer, the term of this patent is extended or adjusted under 35 U.S.C. 154(b) by 0 days.

(21) Appl. No.: 09/390,778

(22) Filed: Sep. 7, 1999

(51) Int. Cl.[7] ..... E04F 19/04
(52) U.S. Cl. ..... 52/288.1; 52/717.05
(58) Field of Search ..... 52/287.1, 288.1, 52/290, 717.03, 718.02, 718.04, 718.05, 717.05; 174/48, 68.3, 49, 101; 439/209, 216

(56) References Cited

U.S. PATENT DOCUMENTS

| | | | | |
|---|---|---|---|---|
| 3,302,350 | A | 2/1967 | Brown et al. | 52/287.1 |
| 3,707,061 | A | 12/1972 | Collette | 52/288.1 |
| 3,786,171 | A | 1/1974 | Shira | 174/48 |
| 4,534,147 | A | 8/1985 | Cristell | 52/287 |
| 4,627,679 | A | 12/1986 | Billette | |
| 4,800,696 | A | 1/1989 | Miller et al. | 52/221 |
| 4,920,714 | A | 5/1990 | Sease | 52/222 |
| 5,024,614 | A | 6/1991 | Dola et al. | |
| 5,184,441 | A | 2/1993 | Balfanz, Jr. | 52/241 |
| 5,336,849 | A | 8/1994 | Whitney | 174/48 |
| 5,359,817 | A | 11/1994 | Fulton | 52/288.1 |
| 5,728,976 | A | 3/1998 | Santucci et al. | |
| 5,732,747 | A | 3/1998 | Holliday | |
| 5,756,933 | A | 5/1998 | Pitchford et al. | 174/48 |

*Primary Examiner*—Michael Safavi
(74) *Attorney, Agent, or Firm*—Lilling & Lilling P.C.

(57) ABSTRACT

An extender piece is disclosed for use in connection with conventional wall molding. The conventional molding includes opposing legs that define a longitudinal channel for electrical cables and wires. The extender is positioned next to the outer edge of one of the legs of the molding. Included at the outer end of the extender are a support wall and a rib defining a receiving channel. By this means, the cover shield for the molding can have one end secured in the receiving groove on one of the legs of the molding and have its other edge secured within the retaining groove of the extender. By this means, a larger size cover shield can be easily fitted on to the molding, thereby quickly and efficiently increasing the effective size of the longitudinal channel for storing cabling and wiring.

2 Claims, 3 Drawing Sheets

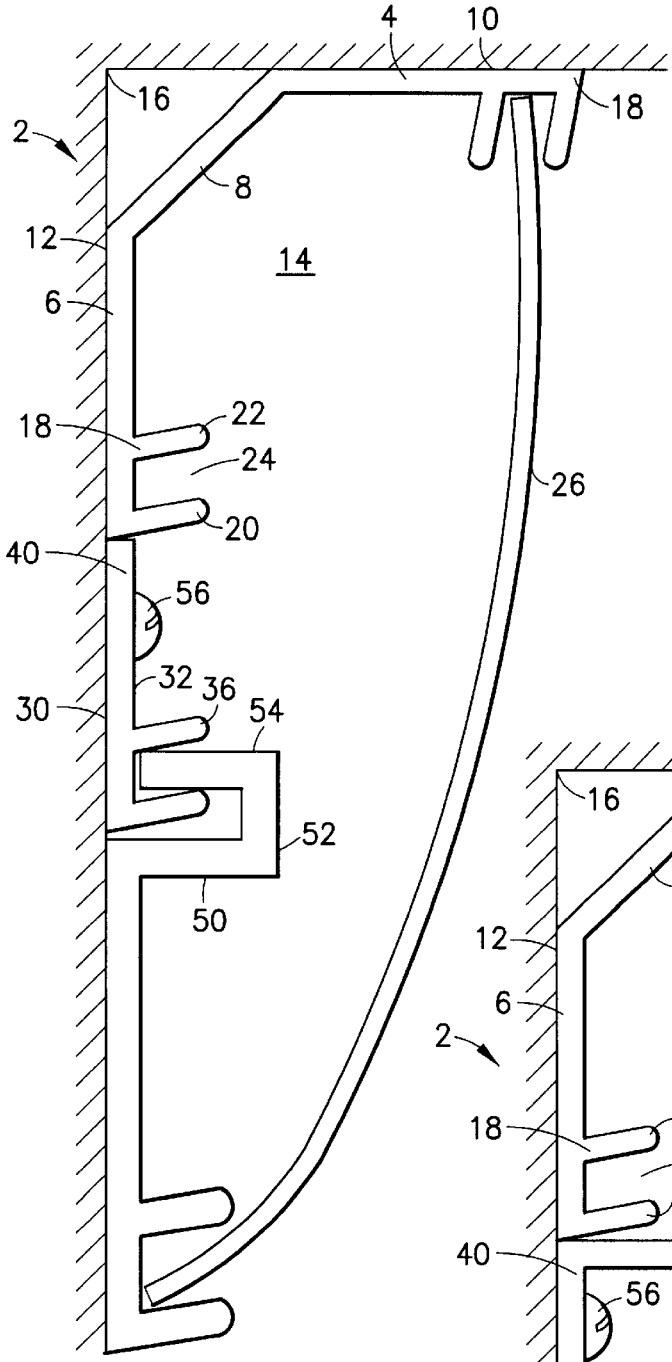
FIG.8
FIG.9
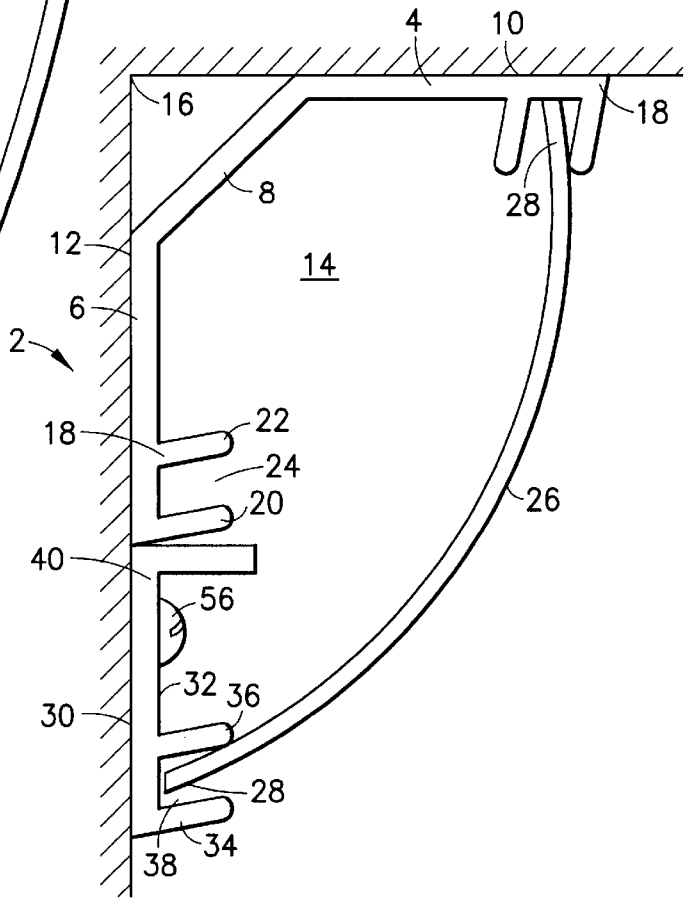

RETROMOLDING EXTENDER

FIELD OF THE INVENTION

This invention relates to the construction industry and, more particularly, to an Extender piece that can be used with existing molding in order to increase the size of the channel for positioning and concealing electrical, video, data, and voice cabling.

BACKGROUND OF THE INVENTION

In the construction industry, there is a need for providing passageways for electrical, video, data, and voice cabling. In modem offices and homes, this need has become even more important than it was in prior years. As offices and homes include ever increasing quantities of electronic equipment, the need for cabling becomes that much more acute.

In former years, a typical home may have just had one or two telephone wires and a couple of electrical cords. With the myriad of electronic equipment available nowadays, including computers, printers, facsimile machines, VCRs, stereo equipment, home entertainment centers, etc., the number of electrical, video, data, and voice wires and cables has increased very substantially. Necessarily, the cables and wires are not attractive and detract from the appearance of the premises. Moreover, they can provide a safety hazard, as people may trip over the wires. This can cause not only an injury to the person who falls, but could cause damage to the equipment when wires or cables are pulled from their proper connections.

Therefore, there is a need in the construction industry to provide passageways where the wires and cables can be positioned and also concealed safely.

Brown (U.S. Pat. No. 3,302,350) discloses one early type of molding construction which accomplishes such a purpose. It includes an attaching member which is affixed in any suitable manner to the wall structure. It includes a hooking protrusion and a groove on its top wall edge for engagement with the matching surfaces on the top cover edge of a cover member. Similarly, on the lower wall edge, there is a snap joint forming arc which engages with a protrusion on the lower cover edge of the cover member. By this means, the molding member defines a continuous channel between the attaching member and the cover member for the positioning of electrical cable. The problem with this construction is that the passageway is of a certain defined size. Once the passageway is fully used, there is no additional room for additional wires and cabling. The only solution is to remove the molding and to install a molding with a larger passageway. This is necessarily very expensive and time consuming.

Another type of molding or raceway for concealing electrical wiring is disclosed by Shira (U.S. Pat. No. 3,786,171). In this device, there is a back member that is positioned in any suitable manner on a wall. Then, there is a cover, which is hingeably connected to the back member at the lower lateral edge. A web is formed on the other end of the cover and it engages a channel on a retaining member at the top of the back member. In this way, the cover is held securely over the back member. Between the back member and the cover, one or more channels are defined for wiring an electrical cable. Again, this device suffers from the same deficiency. Once the interior space is completely used, no additional wiring or cabling can be installed. The only solution is to take down the raceway and install a molding or raceway with a larger interior passageway. This necessarily is time consuming and expensive.

A more modern construction for concealing electrical cabling is disclosed by Sease (U.S. Pat. No. 4,920,714), but it suffers from the same deficiencies. This device includes a molding element which is mounted in any suitable manner on a wall. It includes on one end a groove that is defined between a locking wall and an upstanding rib. Serrations appear in the locking wall. The molding element also includes a central retaining channel. The cover is basically in the shape of an upside-down W. It has a channel structure at its center which snaps into the retaining channel that is defined by resilient walls. At one end of the cover there is a wall with serrations that enter into the groove between the rib and the locking wall and engage with the serrations on the locking wall. In this manner, the cover and the molding member are held securely together. Again, the problem with this structure is that, while it provides passageways for wires and cabling, there is only a certain amount of available space. Once the interior passageway is completely utilized, no additional wires and cabling can be installed. The only solution is to remove the device and install with a larger interior passageway. Further, the primary purpose of this device is not even to install cabling and its primary purpose is to mount accent strips for the house. It is only by chance that the construction includes a passageway that could conceivably be used for cabling.

A more recent patent Holliday (U.S. Pat. No. 5,732,747) discloses a cove molding cover for electrical cables. This device includes a plurality of clip members which are attached in any appropriate manner to a wall. On each of the lateral edges, there are upturned edges which define a bead. The cover panel includes turned-over edges which define a lip and a cavity running the length of the cover. This permits the cover to be slid on to the beads of the clips and to be held securely. Necessarily, it defines a channel between the clips and the cover which may be used for positioning and concealing wires and electrical cabling. Again, this device suffers from the same deficiency. Once the entire of the interior cavity is filled, no additional cabling or wire can be utilized. If more cabling or wiring needs to be installed, then it is necessary to remove the device and install another device with a larger passageway.

Another prior art device is shown in FIG. 1 herein. In particular, it includes a molding piece with legs that are affixed to the ceiling and to the wall, and with a connector piece between them. The edge of each leg has upstanding ribs to define a retaining channel. A cover of pliable material, such as sheet metal, is flexed, so that its ends fit into the two retaining grooves. Again, the problem with this design is that the internal passageway for the wires and cables is of only a finite size. Once the passageway is filled, there is no additional room for adding more cable and wires. The solution is to remove the molding and replace it with molding of a larger size.

Therefore, it can be seen that a significant disadvantage of the prior art is that there is no convenient way to increase the size of the passageway to make room for additional wires and cabling. These devices of the prior art all require that they be removed and replaced with larger moldings in order to create larger passageways for additional cabling and wires. There is no simple and cost-effective device or procedure for quickly and efficiently increasing the passageway size without replacing the molding.

SUMMARY OF THE INVENTION

Therefore, it is an object of this invention to provide a simple, easy-to-use device that can be fitted with conventional moldings, so as to increase the size of the passageway to permit the positioning of additional wires and cables.

This and other objects of the invention can be obtained with a simple Extender piece that is fitted next to one of the legs of the prior art molding device. At the edge of the Extender piece, there are upstanding ribs that define a retaining channel. This enables a larger cover to be used and to be inserted into the retaining channel of the Extender piece, instead of the retaining channel on the leg of the original molding. By this means, the effective size of the passageway is increased and additional cabling and wiring can be positioned within the molding without the need for removing and installing molding of a larger size.

The Extender of this invention was created to meet an increasing demand for greater cabling capacity. Though there are many upgrades that can be used to meet these demands, each of them has their own deficiencies.

At the outset, the only way to truly increase the cabling capacity of any molding was to take it out and install a larger one. During the process of removing the molding, various additional problems are encountered. First, the wall may be damaged, thereby requiring repair to the wall and new painting. Another no less important problem was that the removal process caused a disruption to existing services, because the cabling needs to be removed for the molding to be removed.

None of these problems exist with the Extender of this invention. Because the original molding is being used, except for the cover shield, there is no need to repair walls or to repaint. Further, because the existing molding is not being removed, the cabling itself does not need to be removed and service is not interrupted.

Moreover, in a more enlightened society which is ever increasingly conscience about waste, the extender makes it possible to avoid the substantial waste of disregarding the prior molding.

Therefore, it can be seen that there are significant and important advantages to the Extender of this current invention.

BRIEF DESCRIPTION OF THE INVENTION

FIG. 8 is a side view showing the alternate embodiment of the Extender piece of this invention connected to another extender of the type shown in FIG. 5.

FIG. 9 is a side view of the alternate embodiment of the Extender piece with the alignment guide in position against a conventional molding piece.

DETAILED DESCRIPTION OF THE INVENTION

Figure 3:
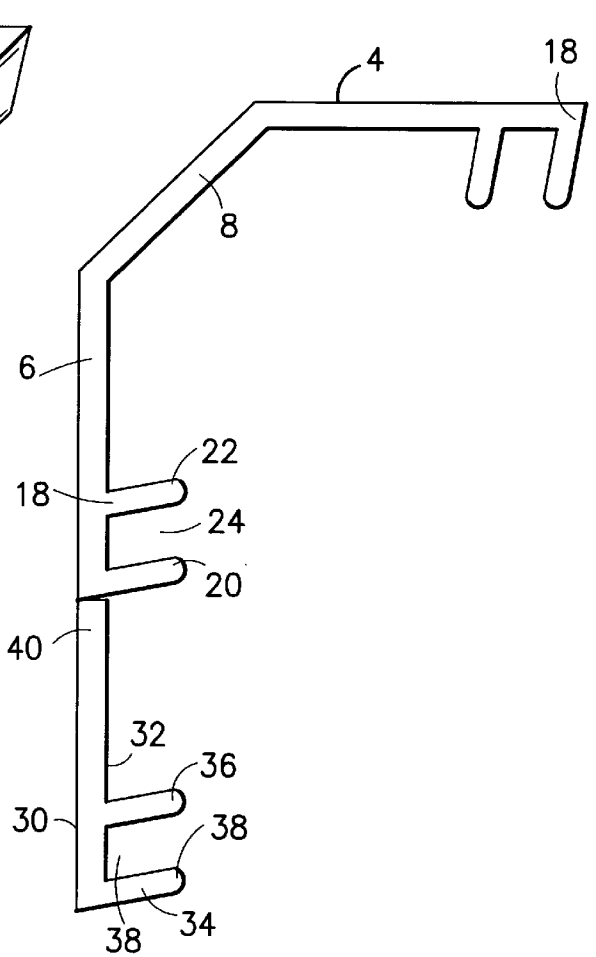
FIG. 3 is a side view of the instant invention without the cover shield.
Figure 2:
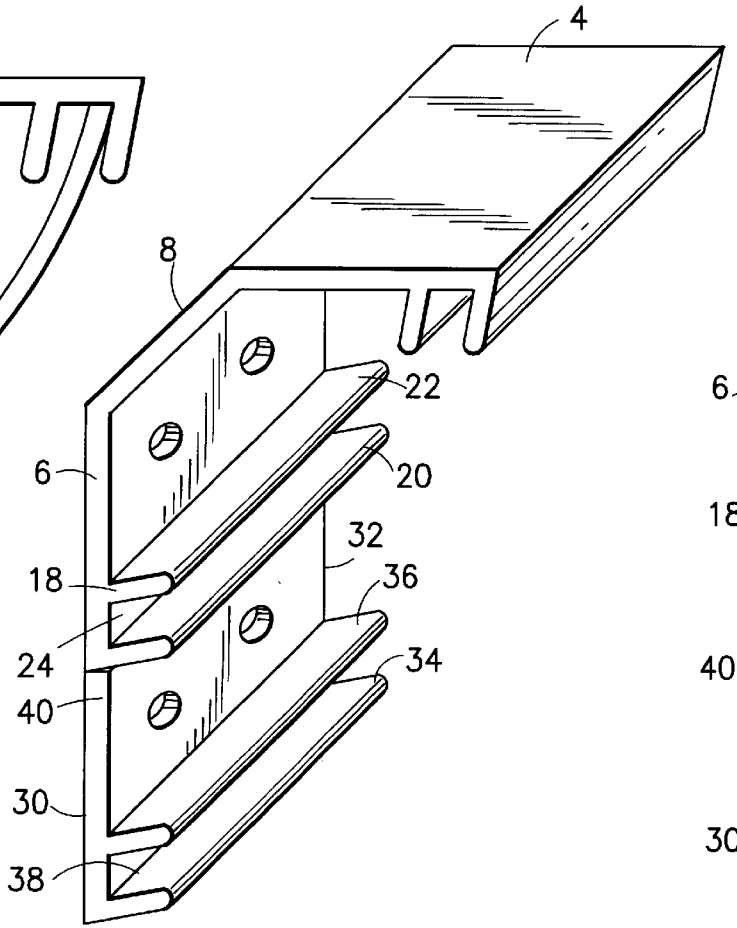
FIG. 2 is a perspective view of the invention without the cover shield.
Figure 1:
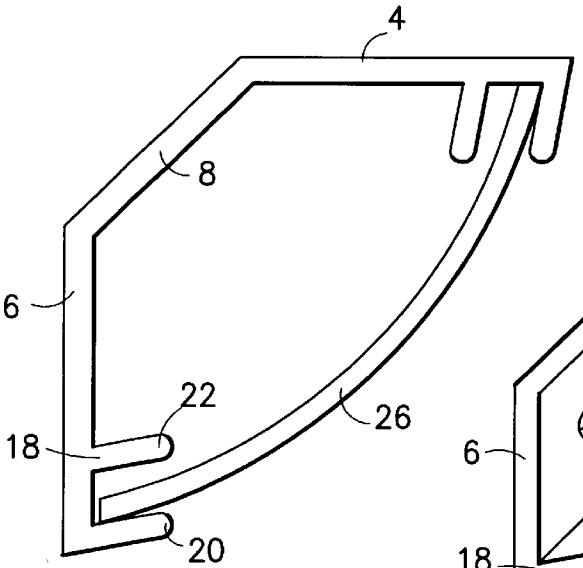
FIG.1 PRIOR ART
FIG. 1 is a side view of a molding piece with a channel for wires and cables, according to the prior art.

The basic invention is very much of the type shown in FIG. 1, except that it additionally includes an Extender piece, which allows the same piece of molding to be used, but with a larger size cover shield, so as to effectively increase the size of the internal passageway.

The standard molding piece 2 may be made out of any suitable material, as are particularly known in the trade. For example, it may be made of wood, aluminum, metal or plastic. The strength requirement is that it must be sufficiently sturdy, so as to not come apart when the wires and cabling are installed, and to hold the cover shield in position.

The molding 2 includes top and bottom legs 4 and 6, connected by a connecting leg 8. In most embodiments, it would be made as one continuous piece, defining a longitudinal channel 14 along its length. As stated, this is well known in the industry.

In the preferred arrangement, the top leg 4 may be affixed to the ceiling 10 or top wall in any suitable manner, as by adhesives, screws, bolts, as is well known in the industry. In a similar manner, the leg 6 is secured to the vertical wall 12 in a similar manner, as by adhesives, screws, bolts, as is known in the trade. The location of the molding 2 is typically at the corner 16, where the ceiling 10 and the wall 12 meet.

The particular length of the molding 2 will be dependent on the size of the ceiling and the walls. Typical pieces of molding may come in lengths of one foot, two foot or any desirable length. The particular length is not critical to the invention.

At the distal ends 18 of the upper and lower legs 4 and 6, there are retaining wall 20 and an upstanding rib 22, defining between them a retaining groove 24. This retaining groove 24 extends along the entire length of the molding.

As taught by the prior art, a flexible cover shield 26 is made of any suitable material, such as plastic, metal or aluminum. The particular material is not critical, as long as it is sufficiently sturdy, to properly shield the wires and cables and still sufficiently flexible to fit into the retaining grooves on the molding. In the prior art device, the ends 28 of the cover shield are flexed, so as to be positioned within the retaining grooves 24 on the legs of the molding.

In operation, the shield 26 would be flexed, so as to remove the ends from the retaining grooves. This would provide access to the longitudinal passageway 14 and the wires and cabling can be installed. After installation of the cables and wires, the ends of the cover shield are flexed, so as to position the ends of the cover shield within its retaining grooves of the legs of the molding. In this manner, a continuous, finished molding is provided.

The invention consists of an Extender piece 30 which is used in combination with the standard molding 2. It may be fitted either next to the lower leg 6, as shown in the drawings, or next to the top leg 4. In either case, the Extender piece will work in the same manner.

The Extender piece may be made of any suitable material, such as plastic, metal, aluminum, or wood. It includes a flat base 32. At one end there is a retaining wall 34 and an upstanding rib 36 which define between them a retaining groove 38. Preferably, the length of the Extender is the same as the molding in connection with which it is being used.

In one particular embodiment, the Extender is three-quarters of an inch in width and the retaining wall 34 and upstanding rib 36 have a height of 0.2 inches and define a retaining groove 38 having a width of 0.134 inches. The thickness of the base is 0.05 inches.

As shown in the preferred embodiment, in order for the retaining groove 38 to more properly secure and hold the cover shield, the upstanding rib 36 should be angled slightly, so that it is at an angle of approximately 82° to the plane of the base. The invention will work, however, if the upstanding rib and the retaining wall are at a right angle to the plane of the base. It will depend on the specific shape, configuration and the material of the cover shield.

Figure 4:
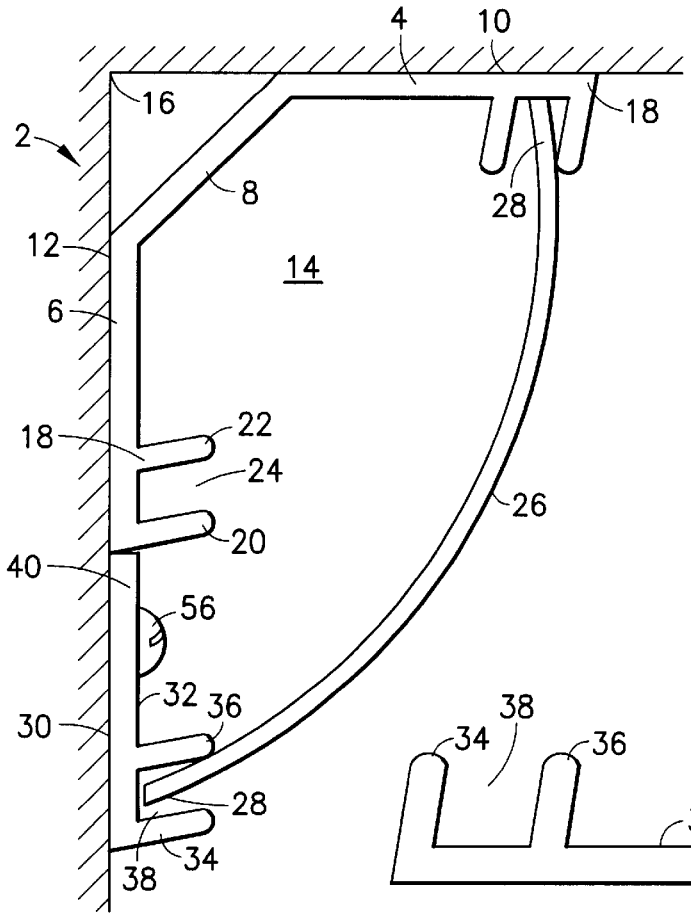
FIG. 4 is a side view of the invention with the cover shield installed.

The Extender 30 is positioned so that the end 40 opposite the retaining wall 34 is butted up against the retaining wall 20 of one of the legs of the molding. Then, the Extender is secured to the wall (or the ceiling) in any suitable manner, as by adhesives, screws or bolts. As shown in FIG. 4, one way to do this is with a screw 56.

By this simple expedient and easy-to-install Extender, the effective size of the internal passageway 14 is increased dramatically. Instead of using the cover shield from the original molding, a cover shield of the same type, but of a larger size, can now be used. One end 28 is secured within the retaining groove 24 on one of the legs of the molding, and now the other end 28 is secured within the retaining groove 38 of the Extender. This necessarily permits a tradesman to quickly install the Extenders and change cover shields and in a very short period of time dramatically increase the size of the passageway to permit the positioning of more cables and wires.

Figure 6:
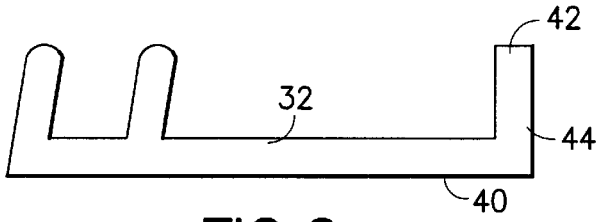
FIG. 6 is an alternate embodiment of the Extender piece of this invention and which includes an alignment guide.

In an alternate embodiment of the Extender, as shown in FIG. 6, at the inner end 40 of the Extender, there is an alignment guide 42. It is made integral with the Extender, and consists of a simple upstanding wall or rib 42, which extends upward from the base 32. The outer surface 44 of the alignment guide 42 is butted against the retaining wall 20 on the respective leg of the molding, and facilitates proper positioning of the Extender 30 (see FIG. 9).

Figure 7:
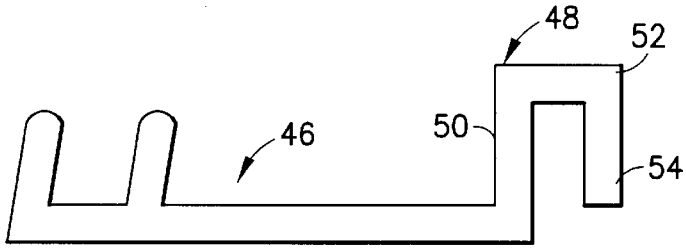
FIG. 7 is a side view of an alternate embodiment of the Extender piece of this invention with a connector to another extender piece.

Another variation of the Extender is illustrated in FIG. 7. This variation constitutes a second extender which may be used in combination with either the basic Extender of FIG. 5 or the Extender with alignment guide of FIG. 6.

Figure 5:
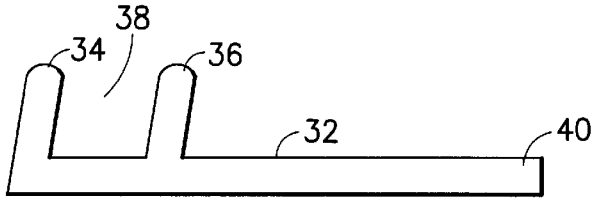
FIG. 5 is a side view of the Extender piece of this invention, which is used in conjunction with the conventional molding.

The modified Extender 46 is in basic construction and shape the same as the basic Extender 30 of FIG. 5. It additionally includes a connecting structure 48, so that the second Extender can be connected to the basic Extender and to permit an even larger sized passageway to be created. The connecting structure 48 includes a U-shaped structure, composed of a support wall 50, a top connecting portion 52 and a connecting leg 54. Generally speaking, they would be made integral to the connecting portion 48.

In operation, the second extender 46 would be moved next to the basic Extender 32 and the connecting leg 54 would be fitted into the retaining groove 38 in a manner similar to the end of the cover shield being inserted into the retaining groove 38 (see FIG. 8). Once this is accomplished, the base of the second extender is secured to the wall in any appropriate manner.

The invention is described in detail with reference to a particular embodiment, but it should be understood that various other modifications can be effected and still be within the spirit and scope of the invention.

I claim:

1. A device for retaining cabling along an intersection of walls and ceilings of a building structure comprising: (a) a molding for attachment to said walls and ceilings and said molding having opposing legs defining a concealed longitudinal passageway for said cabling, wherein each of said legs of said molding includes retaining grooves; (b) a separate extender that is not made integral with said molding, and said extender having a first end butted against an end of one of the said legs of said molding and a second end of said extender having a retaining wall and a rib defining a retaining groove; (c) an extension having a first end with a connecting structure for securement within said retaining groove of said extender, and a second end of said extension having a retaining wall and a rib defining a receiving groove; and (d) an increased size cover shield having one end inserted into a retaining groove in one of said legs of said molding and a second end inserted within said retaining groove of said extension.

2. A device according to claim 1, wherein said extender further includes an alignment guide butted against an end of one of said legs of said molding.

* * * * *